US007434684B1

(12) United States Patent
Mabra

(10) Patent No.: US 7,434,684 B1
(45) Date of Patent: Oct. 14, 2008

(54) BROAD HEAD COVER DEVICE

(76) Inventor: Robby L. Mabra, Route 2 Box 208, Cheyenne, OK (US) 73628

( * ) Notice: Subject to any disclaimer, the term of this patent is extended or adjusted under 35 U.S.C. 154(b) by 221 days.

(21) Appl. No.: 11/414,467

(22) Filed: May 1, 2006

(51) Int. Cl.
*B65D 85/00* (2006.01)
*B65D 8/18* (2006.01)

(52) U.S. Cl. ..... 206/315.11; 206/349; 220/4.23; 220/4.24

(58) Field of Classification Search ..... 206/349, 206/361–368, 315.1, 315.11; 220/4.21–4.27; 150/154; 473/578–582, 583
See application file for complete search history.

(56) References Cited

U.S. PATENT DOCUMENTS 1,554,653 A 9/1925 Poole
3,110,336 A 11/1963 Sukala, Jr.
3,229,809 A * 1/1966 Spadaro ..... 220/4.21
3,645,419 A * 2/1972 Shorrock ..... 220/4.22
3,672,677 A 6/1972 Moore
4,093,230 A 6/1978 Simo
4,466,585 A * 8/1984 Maehara ..... 220/4.21
5,042,658 A * 8/1991 Tiramani et al. ..... 206/349
5,076,460 A * 12/1991 Hussell ..... 220/4.22
5,156,267 A * 10/1992 Yates et al. ..... 220/4.23
5,158,749 A * 10/1992 Eberle ..... 220/4.23
5,340,086 A * 8/1994 Dorr ..... 220/4.23
5,539,950 A * 7/1996 Zar et al. ..... 206/349
5,803,069 A 9/1998 Schreiber
5,924,567 A * 7/1999 Wenum ..... 206/362.3
D419,765 S 2/2000 Rodgers et al.
6,634,503 B2 * 10/2003 Welsh, Jr. ..... 206/349

* cited by examiner

*Primary Examiner*—Bryon P Gehman

(57) ABSTRACT

A broad head cover device for encasing a broad head to protect the broad head during storage and transport includes a pair of clamshell portions being positionable around the broad head to enclose the broad head between the clamshell portions. The clamshell portions inhibit contact with the broad head when the clamshell portions are positioned around the broad head. One of the clamshell portions is hingedly coupled to the other one of the clamshell portions to permit pivoting of the clamshell portions between a closed position and an open position. A latching assembly includes a first mating portion and a second mating portion. The first mating portion is coupled to one of the clamshell portions and the second mating portion is coupled to the other one of the clamshell portions. The first mating portion mates with the second mating portion to releasably secure the clamshell portions in the closed position.

15 Claims, 5 Drawing Sheets

BROAD HEAD COVER DEVICE

BACKGROUND OF THE INVENTION

1. Field of the Invention

The present invention relates to arrowhead sleeves and more particularly pertains to a new arrowhead sleeve for encasing a broad head to protect the broad head during storage and transport.

2. Description of the Prior Art

The use of arrowhead sleeves is known in the prior art. The prior art commonly teaches a sleeve that is slid over an arrowhead to encase the arrowhead.

While these devices fulfill their respective, particular objectives and requirements, the need remains for a device that has certain improved features that encase a broad head attached to an arrow shaft and are secured around the broad head to inhibit removal of the device from the broad head. Additionally, the device can be equipped with weep holes to allow liquid on the broad head to drain away to limit corrosion of the broad head by the liquid.

SUMMARY OF THE INVENTION

The present invention meets the needs presented above by generally comprising a pair of clamshell portions being positionable around the broad head to enclose the broad head between the clamshell portions. The clamshell portions inhibit contact with the broad head when the clamshell portions are positioned around the broad head. One of the clamshell portions is hingedly coupled to the other one of the clamshell portions to permit pivoting of the clamshell portions between a closed position and an open position. A latching assembly includes a first mating portion and a second mating portion. The first mating portion is coupled to one of the clamshell portions and the second mating portion is coupled to the other one of the clamshell portions. The first mating portion mates with the second mating portion to releasably secure the clamshell portions in the closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
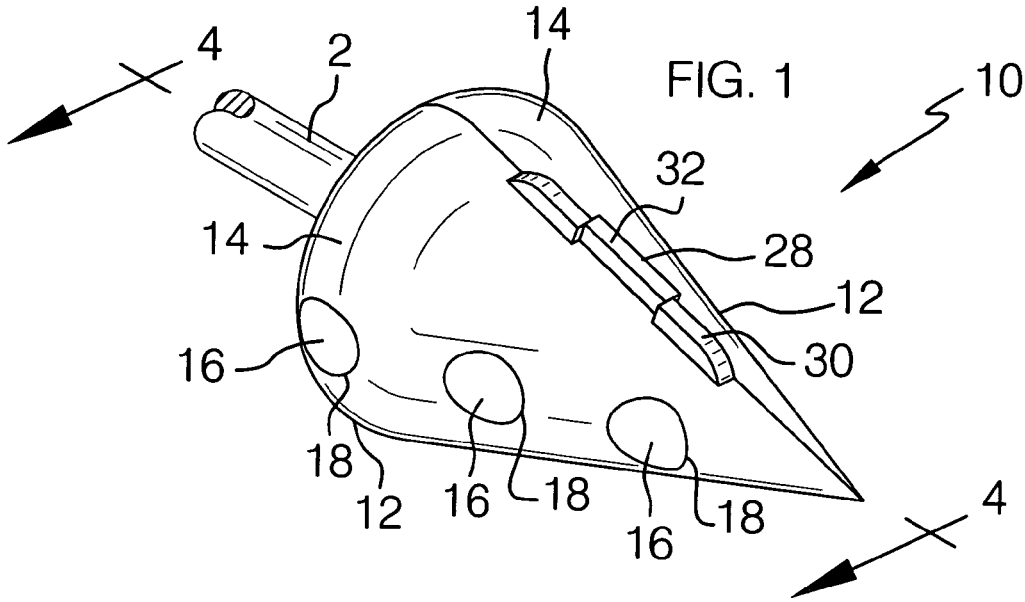
FIG. 1 is a front perspective view of a broad head cover device according to the present invention.
Figure 2:
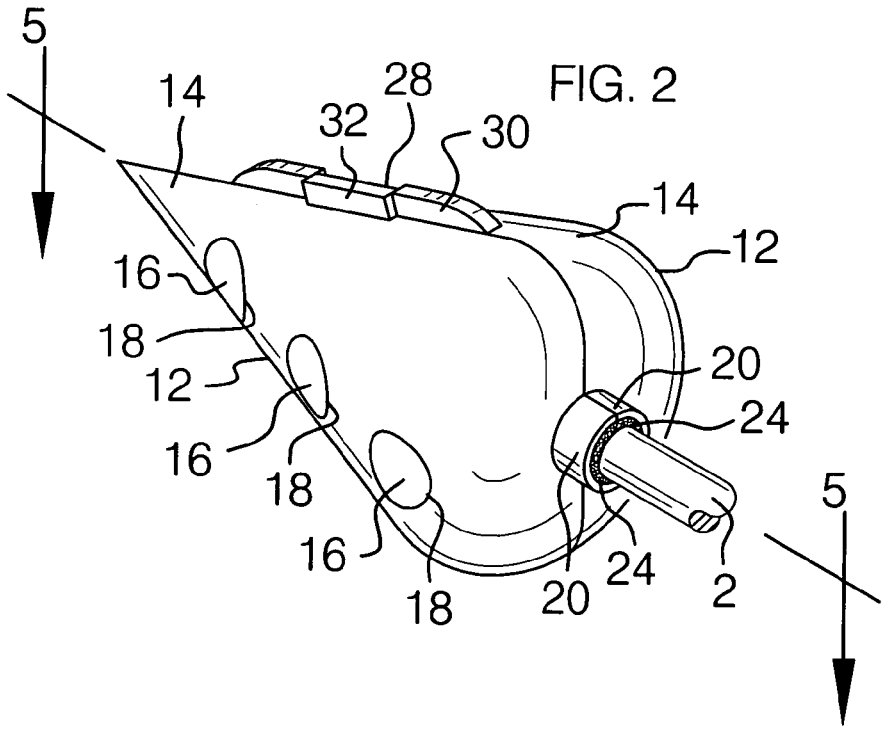
FIG. 2 is a rear perspective view of the present invention.
Figure 3:
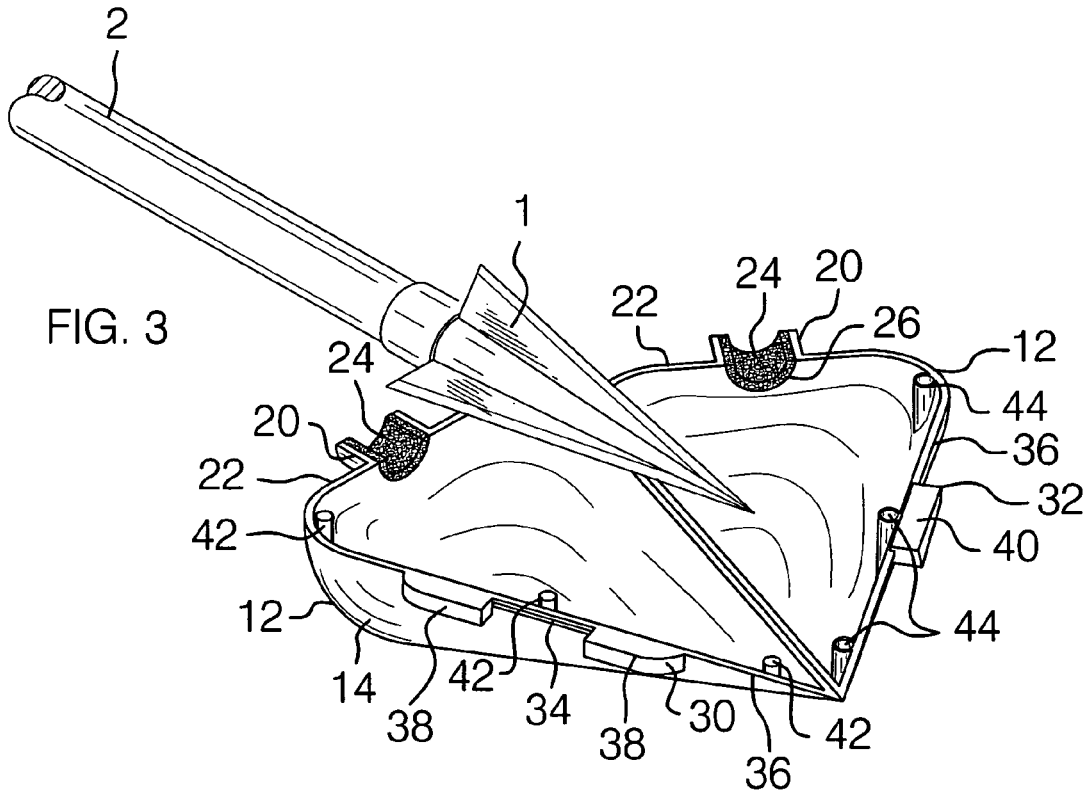
FIG. 3 is a perspective view of the present invention showing the clamshell portions in the open position.
Figure 4:
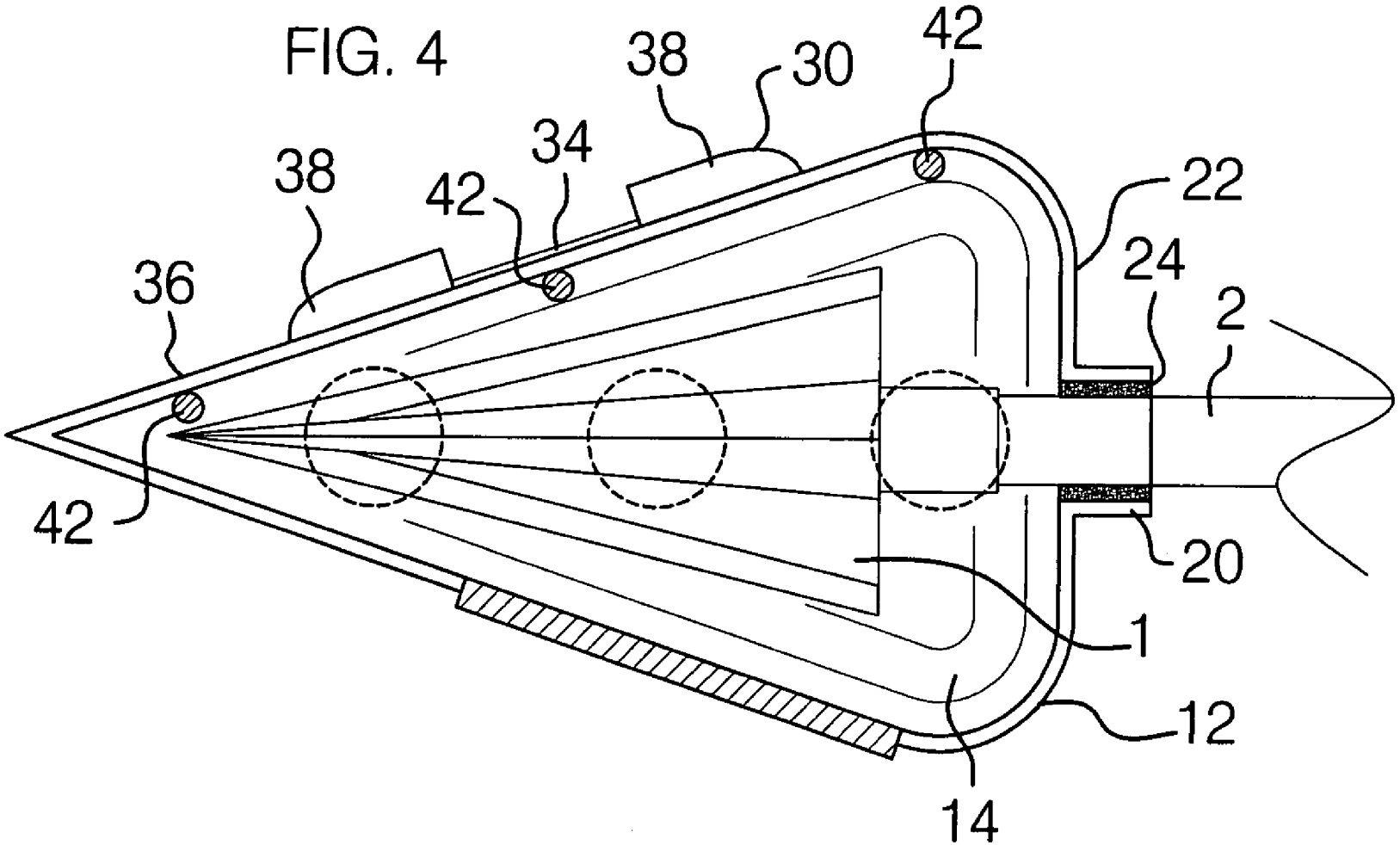
FIG. 4 is a cross-sectional view of the present invention taken along line 4-4 of FIG. 1.
Figure 5:
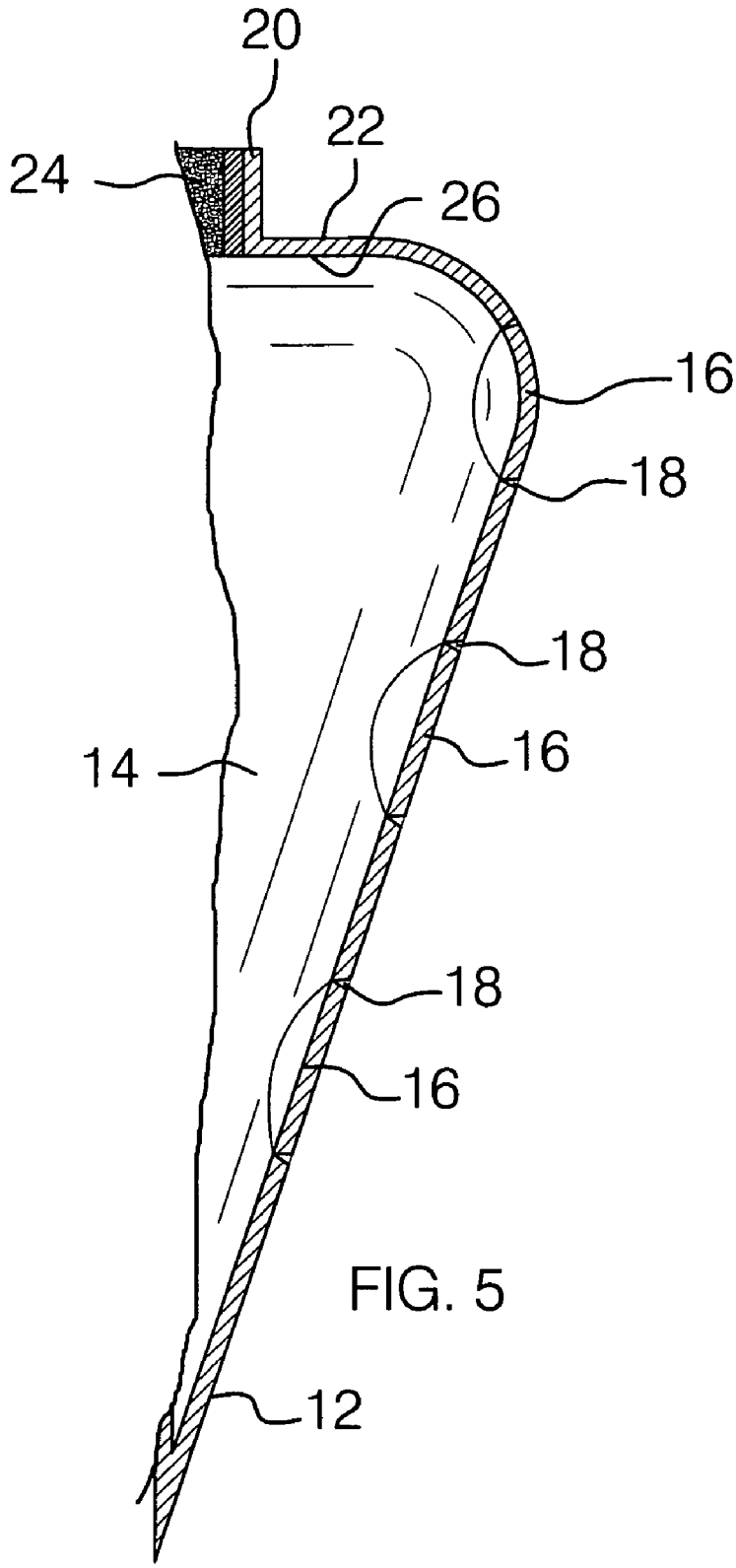
FIG. 5 is a partial cross-sectional view of the present invention taken along line 5-5 of FIG. 2.

With reference now to the drawings, and in particular to FIGS. 1 through 6 thereof, a new arrowhead sleeve embodying the principles and concepts of the present invention and generally designated by the reference numeral 10 will be described.

As best illustrated in FIGS. 1 through 6, the broad head 1 cover device 10 generally comprises a pair of clamshell portions 12 being positionable around a broad head 1 to enclose the broad head 1 between the clamshell portions 12. The clamshell portions 12 inhibit contact with the broad head 1 when the clamshell portions 12 are positioned around the broad head 1. One of the clamshell portions 12 is hingedly coupled to the other one of the clamshell portions 12 to permit pivoting of the clamshell portions 12 between a closed position and an open position.

Each of the clamshell portions 12 includes a head portion 14 for receiving a portion of the broad head 1. The head portion 14 of each of the clamshell portions 12 is substantially cone shaped when the clamshell portions 12 are in a closed position. The head portion 14 has a plurality of knockouts 16 positioned in the head portion 14. Each of the knockouts 16 is removable from the head portion 14 to expose one of a plurality of weep holes 18 extending into the head portion 14. Each of the weep holes 18 permits liquid on the broad head 1 to drain from the clamshell portions 12. A shaft sleeve 20 is integrally coupled to a base edge 22 of the head portion 14. The shaft sleeve 20 receives a portion of an arrow shaft 2 when the clamshell portions 12 are closed around the broad head 1. The shaft sleeve 20 has a substantially semi-cylindrical shape.

Each of the clamshell portions 12 also includes a liner 24 coupled to an interior surface 26 of the shaft sleeve 20. The liner 24 abuts the arrow shaft 2 to inhibit sliding of the clamshell portions 12 along the arrow shaft 2 when the clamshell portions 12 are positioned around the broad head 1. The liner 24 is comprised of a resiliently compressible material to accommodate arrow shafts 2 of varying diameters and to increase friction between the liner 24 and the arrow shaft 2.

A latching assembly 28 includes a first mating portion 30 and a second mating portion 32. The first mating portion 30 is coupled to one of the clamshell portions 12 and the second mating portion 32 is coupled to the other one of the clamshell portions 12. The first mating portion 30 mates with the second mating portion 32 to releasably secure the clamshell portions 12 in the closed position. The first mating portion 30 includes a lip 34 extending outwardly from a free edge 36 of the head portion 14 of the associated one of the clamshell portions 12. The first mating portion 30 includes a pair of leverage tabs 38 coupled to the free edge 36 of the head portion 14 on opposing sides of the lip 34.

The second mating portion 32 includes a latch tab 40 coupled to the free edge 36 of the head portion 14 of the associated one of the clamshell portions 12. The latch tab 40 is extendable over the lip 34 of the second mating portion 32 to releasably secure the clamshell portions 12 in the closed portion. The latch tab 40 is positioned between the leverage tabs 38 when the clamshell portions 12 are in the closed position.

In an embodiment, as shown in FIGS. 1 through 4, each of a plurality of alignment pins 42 is coupled to the interior surface 26 of one of the clamshell portions 12. Each of a plurality of alignment sleeves 44 is coupled to the interior surface 26 the other one of the clamshell portions 12. Each of the alignment sleeves 44 receives one of the alignment pins 42 to maintain alignment of the clamshell portions 12 when the clamshell portions 12 are in the closed position. The alignment pins 42 are positioned adjacent to the free edge 36 of the head portion 14 and positioned opposite the first mating portion 30. The alignment sleeves 44 are positioned adjacent the free edge 36 of the head portion 14 of the other one of the clamshell portions 12 and positioned opposite the second mating portion 32.

Figure 6:
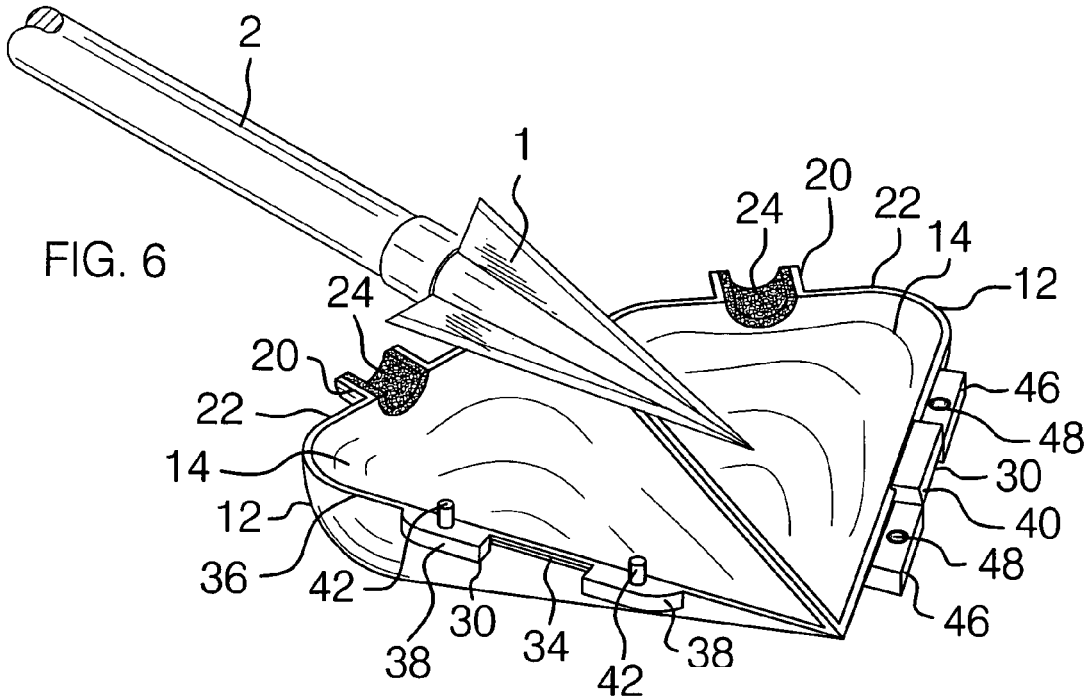
FIG. 6 is a perspective view of an embodiment of the present invention showing the clamshell portions in the open position.

In an embodiment, as shown in FIG. 6, the second mating portion 32 includes a pair of flanking tabs 46 coupled to the free edge 36 of the associate one of the clamshell portions 12. The flanking tabs 46 are positioned on opposing sides of the latch tab 40. The flanging tabs 46 are aligned with the leverage tabs 38 when the clamshell portions 12 are in the closed position. Each of the leverage tabs 38 has at least one alignment pin 42 extending outwardly from the associated one of the leverage tabs 38. Each of the flanking tabs 46 has at least one alignment aperture 48 extending into the associated one of the flanking tabs 46. The at least one alignment pin 42 of each of the leverage tabs 38 is inserted into the at least one alignment aperture 48 of an aligned and associated one of the flanking tabs 46 to maintain alignment of the clamshell portions 12 in the closed position.

In use, the broad head 1 is positioned in the head portion 14 of one of the clamshell portions 12 with arrow shaft 2 positioned in the shaft sleeve 20 of the associated one of the clamshell portions 12. The other one of the clamshell portions 12 is pivoted over the broad head 1 to enclose the broad head 1 in the head portion 14 of the clamshell portions 12. The first mating portion 30 and the second mating portion 32 are releasably mated to secure the clamshell portions 12 in the close position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A broad head cover device for inhibiting contact with a broad head during storage and transport, the device comprising:

a pair of clamshell portions being positionable around the broad head to enclose the broad head between said clamshell portions, said clamshell portions inhibiting contact with the broad head when said clamshell portions are positioned around the broad head, one of said clamshell portions being hingedly coupled to the other one of said clamshell portions to permit pivoting of said clamshell portions between a closed position and an open position, each of said clamshell portions including;

a head portion capable of receiving a portion of the broad head when said clamshell portions are closed around the broad head;

a shaft sleeve being integrally coupled to a base edge of said head portion, said shaft sleeve receiving a portion of an arrow shaft when said clamshell portions are closed around the broad head;

a liner coupled to an interior surface of said shaft sleeve, said liner abutting the arrow shaft to inhibit sliding of said clamshell portions along the arrow shaft when said clamshell portions are positioned around the broad head; and a latching assembly including a first mating portion and a second mating portion, said first mating portion being coupled to one of said clamshell portions and said second mating portion being coupled to the other one of said clamshell portions, said first mating portion mating with said second mating portion to releasably secure said clamshell portions in the closed position.

2. The device according to claim 1, wherein said head portion of each of said clamshell portions has a plurality of knockouts positioned in said head portion, each of said knockouts being removable from said head portion to expose one of a plurality of weep holes extending into said head portion, each of said weep holes permitting liquid on the broad head to drain from said clamshell portions.

3. The device according to claim 1, wherein said liner of each of said clamshell portions is comprised of a resiliently compressible material to accommodate arrow shafts of varying diameters and to increase friction between said liner and the arrow shaft.

4. The device according to claim 1, wherein said first mating portion includes a lip extending outwardly from a free edge of the associated one of said clamshell portions.

5. The device according to claim 4, wherein said second mating portion includes a latch tab being coupled to said free edge of the associated one of said clamshell portions, said latch tab being extendable over said lip of said second mating portion to releasably secure said clamshell portions in the closed portion.

6. The device according to claim 5, wherein said first mating portion includes a pair of leverage tabs being coupled to said free edge of said head portion on opposing sides of said lip, said latch tab being positioned between said leverage tabs when said clamshell portions are in the closed position.

7. The device according to claim 6, wherein said second mating portion includes a pair of flanking tabs coupled to said free edge of the associated one of said clamshell portions, said flanking tabs being positioned on opposing sides of said latch tab, said flanking tabs being aligned with said leverage tabs when said clamshell portions are in the closed position.

8. The device according to claim 7, wherein each of said leverage tabs has at least one alignment pin extending outwardly from the associated one of said leverage tabs, each of said flanking tabs having at least one alignment aperture extending into the associated one of said flanking tabs, said at least one alignment pin of each of said leverage tabs being inserted into said at least one alignment aperture of an aligned and associated one of said flanking tabs to maintain alignment of said clamshell portions in the closed position.

9. The device according to claim 1, further comprising a plurality of alignment pins being coupled to an interior surface of one of said clamshell portions, a plurality of alignment sleeves being coupled to said interior surface the other one of said clamshell portions, each of said alignment sleeves receiving one of said alignment pins to maintain alignment of said clamshell portions when said clamshell portions are in the closed position.

10. The device according to claim 9, wherein said alignment pins are positioned adjacent to a free edge of one of said clamshell portions and positioned opposite said first mating portion, said alignment sleeves being positioned adjacent said free edge of the other one of said clamshell portions and positioned opposite said second mating portion.

11. A broad head cover device for inhibiting contact with a broad head during storage and transport, the device comprising:

a pair of clamshell portions being positionable around the broad head to enclose the broad head between said clamshell portions, one of said clamshell portions being hingedly coupled to the other one of said clamshell portions to permit pivoting of said clamshell portions between a closed position and an open position, each of said clamshell portions comprising:

a head portion capable of receiving a portion of the broad head when said clamshells portions are enclosed over the broad head, said head portion of each of said clamshell portions being substantially cone shaped when said clamshell portions are in a closed position, said head portion having a plurality of knockouts positioned in said head portion, each of said knockouts being removable from said head portion to expose one of a plurality of weep holes extending into said head portion, each of said weep holes permitting liquid on the broad head to drain from said clamshell portions;

a shaft sleeve being integrally coupled to a base edge of said head portion, said shaft sleeve receiving a portion of an arrow shaft when said clamshell portions are closed around the broad head, said shaft sleeve having a substantially semi-cylindrical shape;

a liner being coupled to an interior surface of said shaft sleeve, said liner abutting the arrow shaft to inhibit sliding of said clamshell portions along the arrow shaft when said clamshell portions are positioned around the broad head, said liner being comprised of a resiliently compressible material to accommodate arrow shafts of varying diameters and to increase friction between said liner and the arrow shaft; and a latching assembly including a first mating portion and a second mating portion, said first mating portion being coupled to one of said clamshell portions and said second mating portion being coupled to the other one of said clamshell portions, said first mating portion mating with said second mating portion to releasably secure said clamshell portions in the closed position, said first mating portion including a lip extending outwardly from a free edge of said head portion of the associated one of said clamshell portions, said first mating portion including a pair of leverage tabs being coupled to said free edge of said head portion on opposing sides of said lip, said second mating portion including a latch tab being coupled to said free edge of said head portion of the associated one of said clamshell portions, said latch tab being extendable over said lip of said second mating portion to releasably secure said clamshell portions in the closed portion, said latch tab being positioned between said leverage tabs when said clamshell portions are in the closed position.

12. The device according to claim 11, further comprising a plurality of alignment pins being coupled to said interior surface of one of said clamshell portions, a plurality of alignment sleeves being coupled to said interior surface the other one of said clamshell portions, each of said alignment sleeves receiving one of said alignment pins to maintain alignment of said clamshell portions when said clamshell portions are in the closed position.

13. The device according to claim 12, wherein said alignment pins are positioned adjacent to said free edge of said head portion and positioned opposite said first mating portion, said alignment sleeves being positioned adjacent said free edge of said head portion of the other one of said clamshell portions and positioned opposite said second mating portion.

14. The device according to claim 11, wherein said second mating portion includes a pair of flanking tabs coupled to said free edge of the associated one of said clamshell portions, said flanking tabs being positioned on opposing sides of said latch tab, said flanking tabs being aligned with said leverage tabs when said clamshell portions are in the closed position.

15. The device according to claim 14, wherein each of said leverage tabs has at least one alignment pin extending outwardly from the associated one of said leverage tabs, each of said flanking tabs having at least one alignment aperture extending into the associated one of said flanking tabs, said at least one alignment pin of each of said leverage tabs being inserted into said at least one alignment aperture of an aligned and associated one of said flanking tabs to maintain alignment of said clamshell portions in the closed position.

* * * * *